United States Patent [19]

Smith et al.

[11] 4,324,004

[45] Apr. 13, 1982

[54] METHOD FOR MAKING FUSED COLLARS AND PRODUCT RESULTING THEREFROM

[75] Inventors: Juan A. Smith, Bowling Green, Ky.; Catherine L. Adams; Wayne M. Adams, both of Brundidge, Ala.

[73] Assignee: Union Underwear Company, Bowling Green, Ky.

[21] Appl. No.: 167,103

[22] Filed: Jul. 9, 1980

Related U.S. Application Data

[63] Continuation of Ser. No. 930,419, Aug. 2, 1978, abandoned.

[51] Int. Cl.[3] ..... A41B 3/00; B32B 7/08

[52] U.S. Cl. ..... 2/131; 2/123; 2/143; 83/901; 112/262.1; 112/417; 156/93; 156/155; 156/226; 156/250; 156/309.6; 223/4; 428/246; 428/286

[58] Field of Search ..... 2/98, 116, 123, 131, 2/143; 112/417, 262.1; 156/88, 93, 155, 204, 222, 292, 309.6, 226, 250; 223/2, 4; 428/246, 284, 286; 83/901

[56] References Cited

U.S. PATENT DOCUMENTS

| | | | |
|---|---|---|---|
| 1,968,410 | 7/1934 | Liebowitz | 2/143 X |
| 2,021,833 | 11/1935 | Campbell | 2/143 |
| 2,152,093 | 3/1939 | Rubinstein | 2/131 |
| 2,152,094 | 3/1939 | Rubinstein | 2/131 |
| 2,233,477 | 3/1941 | Hilberg | 2/129 X |
| 2,639,841 | 5/1953 | Liebowitz | 2/143 X |
| 2,676,324 | 4/1954 | Johnson | 2/143 |
| 3,693,191 | 9/1972 | Dowsett | 2/131 |

*Primary Examiner*—Edward C. Kimlin
*Assistant Examiner*—Robert A. Dawson
*Attorney, Agent, or Firm*—Darby & Darby

[57] ABSTRACT

A method is disclosed for constructing a garment collar which includes upper and lower facing strips of a predetermined shape each having a finished and unfinished surface and a lining of the same predetermined shape which has one fusible surface. The facing strips and lining are stacked in alignment so that the lower facing strip is on the bottom with its finished surface facing upward, the upper facing strip is in the middle with its finished surface facing downward, and the fusible lining is on top with its fusible surface facing upward. Next, this stack is stitched around three peripheral edges and is turned inside out so that the lining is disposed between the two facing strips with the finished surfaces of the facing strips directed outward and the fusible surface of the lining facing the unfinished (inner) surface of the lower facing strip. The reversed collar is then again sewn about its periphery and is compressed in a press which provides heat to at least the lower facing strip. The finished collar is attached to a garment so that the upper facing strip is visible when the garment is worn in the usual manner. In the finished collar, the lining is fused only to the lower facing strip, and the upper facing strip is independent of the lining. As a result, collars in which the surface strips and lining are made of fabrics having substantially different shrinking characteristics show no perceptible imperfections after being washed.

12 Claims, 8 Drawing Figures

METHOD FOR MAKING FUSED COLLARS AND PRODUCT RESULTING THEREFROM

This is a continuation of application Ser. No. 930,419, filed Aug. 2, 1978 and now abandoned.

The present invention relates generally to collars employing fusible linings and, more particularly, concerns an improved method for manufacturing such collars and the resulting product.

Collars utilizing fusible or bonded linings are well known and have long been utilized in the manufacture of apparel. For example, such collar constructions are disclosed in U.S. Pat. Nos. 1,968,410 and 2,639,841 to Liebowitz, in U.S. Pat. No. 2,233,477 to Hilberg, and in U.S. Pat. No. 3,693,191 to Dowsett. In these patents, the collar construction includes upper and lower collar facing strips and a lining between them which is bonded or fused to the upper surface strip or to both facing strips.

Such a collar construction has been found to be unacceptable for wash and wear garments in which the upper facing strip of the collar (the one visible when the garment is worn) and the lining shrink by different amounts when washed. For example, when a conventional fusible lining is fused to the upper facing strip of a collar made of knit fabric, wrinkles, bulges or other imperfections may develop on the surface of the collar after it is washed. This results from the unequal shrinkage of the surface strips and the lining and imperfections in the bond between the upper surface strip and the lining. Such collar imperfections detract from the appearance of the entire garment.

Broadly, it is an object of the present invention to provide garment collars with fusible linings, which collars overcome the foregoing disadvantages of existing collars of that type. Specifically, it is within the contemplation of the present invention to provide an improved method for manufacturing collars which overcome these disadvantages.

It is an object of the present invention to provide a collar in which the surface strips and lining are made of fabric shrinking by substantially different amounts when washed, which collar exhibits no perceptible wrinkles or other imperfections after being washed.

It is another object of the present invention to provide a collar and method for manufacturing the same which can be manufactured by existing equipment utilized for that purpose with a minimum of modifications.

It is also an object of the present invention to provide a garment collar and method for manufacturing the same which are convenient and reliable, yet relatively inexpensive in use.

In accordance with an illustrative embodiment demonstrating objects and features of the present invention, a collar is constructed which includes upper and lower facing strips of a predetermined shape each having a finished and unfinished surface and a lining of the predetermined shape which has one fusible surface. As an initial step, the facing strips and lining are stacked in alignment so that the lower facing strip is on the bottom with its finished surface facing upward, the upper facing strip is in the middle with its finished surface facing downward, and the fusible lining is on top with its fusible surface facing upward. Next, this stack is stitched around three edges of its periphery and is turned inside out so that the lining is disposed between the two facing strips. This provides a partially assembled collar in which the finished surfaces of the facing strips are directed outward and the fusible surface of the lining faces the unfinished (inner) surface of the lower facing strip. This partially finished collar is then sewn about its periphery and is compressed in a press which provides heat to at least the lower facing strip. The finished collar is secured to a garment so that the upper facing strip is seen when the garment is worn in the usual manner. In the finished collar, the lining is fused only to the lower facing strip, and the upper facing strip, which is visible when the garment is worn, is independent of the lining. As a result, collars in which the surface strips and lining are made of fabrics having substantially different shrinking characteristics show no perceptible imperfections after being washed.

In accordance with another aspect of the invention, the press also applies heat to the upper facing strip to achieve a degree of back-bleed fusing of the non-fusible surface of the lining. This makes the completed collar more stable and provides a much better finished appearance.

The foregoing brief description, as well as further objects, features and advantages of the present invention will be more completely understood from the following detailed description of a presently preferred, but nonetheless illustrative, embodiment in accordance with the present invention, with reference being had to the accompanying drawings, in which.

Figure 1:
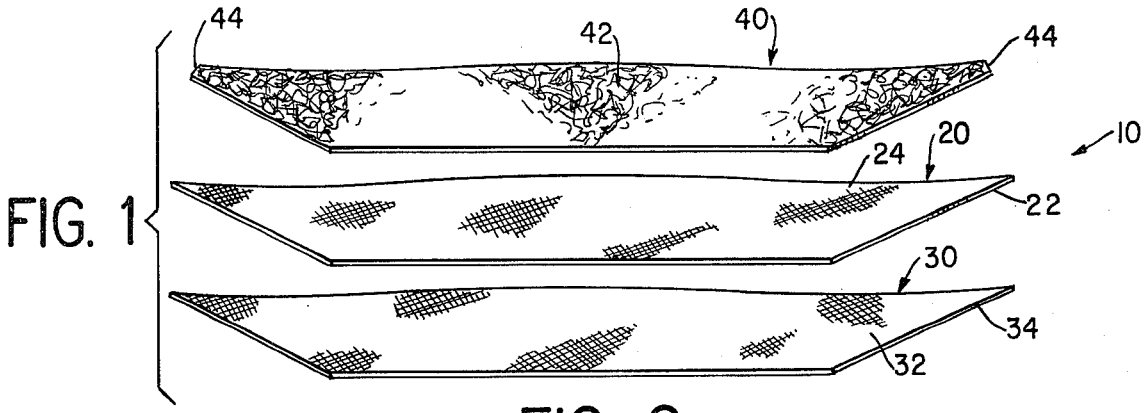
FIG. 1 is an exploded perspective view showing the initial, stacked arrangement of the collar components.

Referring now to the details of the drawings, the invention relates to a garment collar 10 which, in its completed form (see FIGS. 7 and 8), includes: an upper facing strip 20, which is visible when the collar is worn on a garment in the usual manner; a lower facing strip 30, which forms the undersurface of the collar; and a lining 40 which is sandwiched between the upper and lower facing strips and secured to the lower one. As a practical matter, the facing strips 20, 30 are made of a dress fabric which is selected to compliment the appearance of the garment, and the lining 40 is made of a relatively stiff fabric which lends body to the finished collar.

Referring now to FIG. 1, it will be observed that the facing strips 20, 30 are precut to a common, predetermined shape which is designed to yield a collar of a desired appearance. The facing strips 20, 30 each have a finished surface (22 and 32 respectively) and an unfinished surface (24 and 34 respectively), and the lining has a surface 42 with a fusible coating thereon. The lining 40 has the same shape as the facing strips 20, 30 but includes truncations 44 at the location of the collar points 15.

Assembly of the collar is begun by stacking the facing strips and lining in alignment so that the facing strips are on the same side of the lining and with the finished surface of the lower facing strip, the unfinished surface of the upper facing strip and the fusible surface of the lining all facing in the same direction. As shown in FIG. 1, this can be achieved by positioning the lower facing strip 30 with its finished surface 32 facing upward and stacking upon it the upper facing strip 20 with its unfinished surface 24 facing upward, followed by the lining 40 with its fusible surface 42 facing upward.

Figure 2:
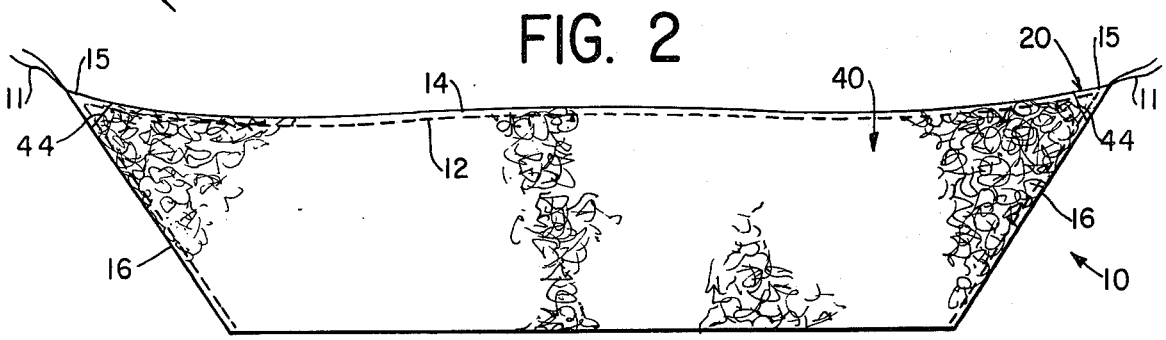
FIG. 2 is a top plan view of the collar after the initial sewing step is completed.

This stacked arrangement is then joined by means of stitching 12, which is provided along the upper edge 14 and the two lateral edges 16 (FIG. 2). Preferably, the stitching 12 is 7/32 of an inch in from the edges of the collar. For purposes of mass production, it has been found convenient to stitch the collar components together continuously, so that a chain of partially assembled collars is formed in which thread 11 extends between successive collars. This makes it more convenient to handle the collars as a group, at this stage.

Figure 3:
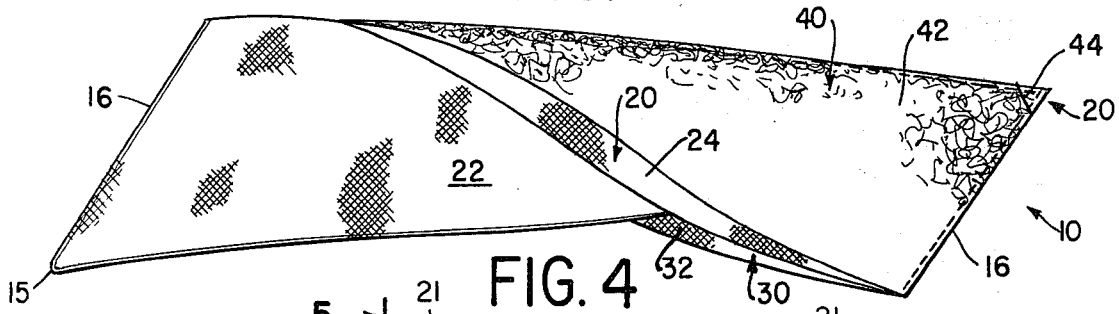
FIG. 3 is a top plan view showing the sewn collar being turned inside out.
Figure 4:
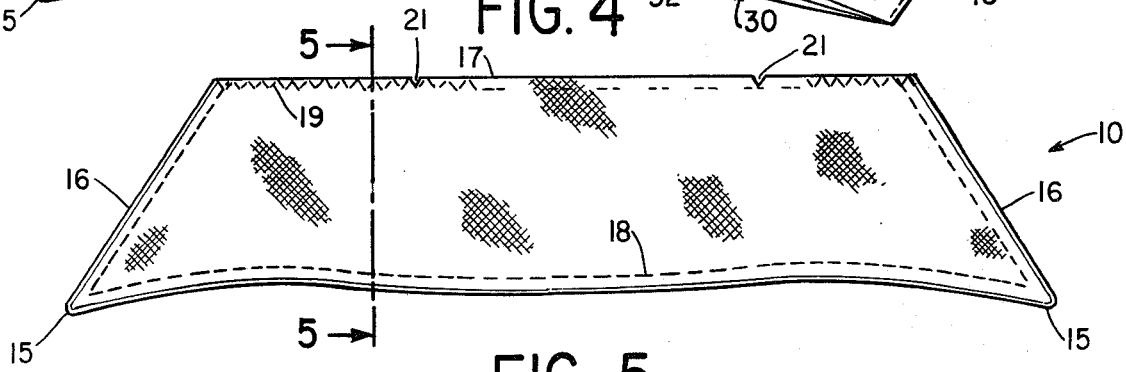
FIG. 4 is a top plan view illustrating the completely reversed collar subsequent to the second stitching operation.
Figure 5:
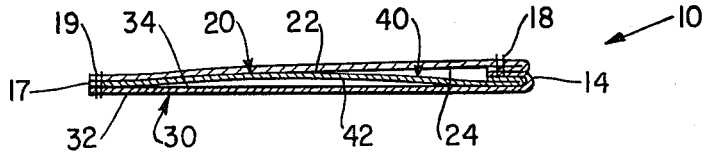
FIG. 5 is a sectional view taken substantially along line 5—5 in FIG. 4.

Following the initial sewing operation, each collar is cut from the threaded chain and excess material is trimmed away from each collar point 15 so that the finished collar will have a sharp point. This operation is performed by conventional trimming equipment. As shown in FIG. 3, the trimmed collar is then turned inside out or reversed on its points. This places the lining 40 between the facing strips 20, 30 and makes the finished surfaces 22, 32 the outer surfaces of collar 10. Following this reversal, top stitching 18 is applied along the edges 14 and 16, preferably at about $\frac{1}{4}$ of an inch from the turned edges (see FIGS. 4 and 5).

As part of the final sewing operation, the edge 17 of each collar is trimmed so that the finished collar will be of a uniform height. Next, a seam row of serge stitching 19 is applied along the trimmed edge 17 of the collar to eliminate puckers and creases when the collar is attached to the neck of a garment. In addition, notches 21 are burned into edge 17 to aid in locating the finished collar for attachment on the neck of the garment. With the completion of these last steps, the collar assumes the form shown in FIGS. 4 and 5.

Figure 6:
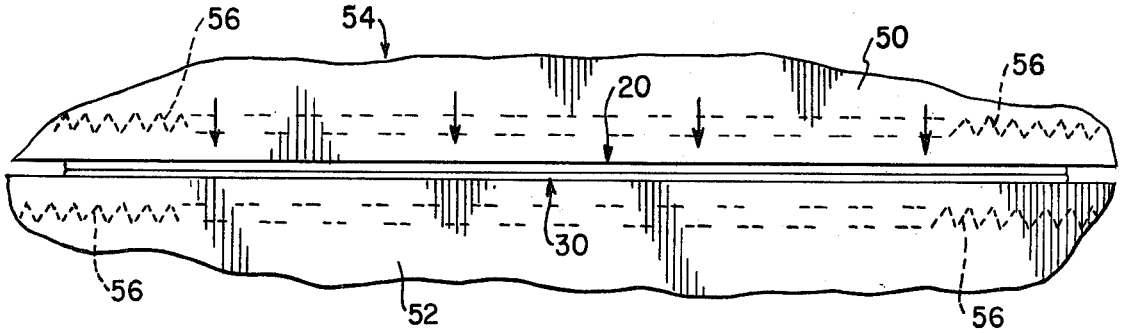
FIG. 6 illustrates the collar being compressed in a press which provides heat to both faces of the collar.

After the foregoing operations, the completely formed collar is compressed (see FIG. 6) between the upper and lower heads 50, 52 of a press 54, which heads also include heating elements 56 to apply heat to each of the facing strips of the collar. It has been found that when a Pellon style KK 208 fusible collar lining is utilized with facing strips made of a knit fabric, the best fused collars are obtained by applying a pressure of 5–6 pounds per square inch at a temperature of 290°–300° Fahrenheit (at the fuse line) for a period of approximately twelve seconds.

Figure 7:
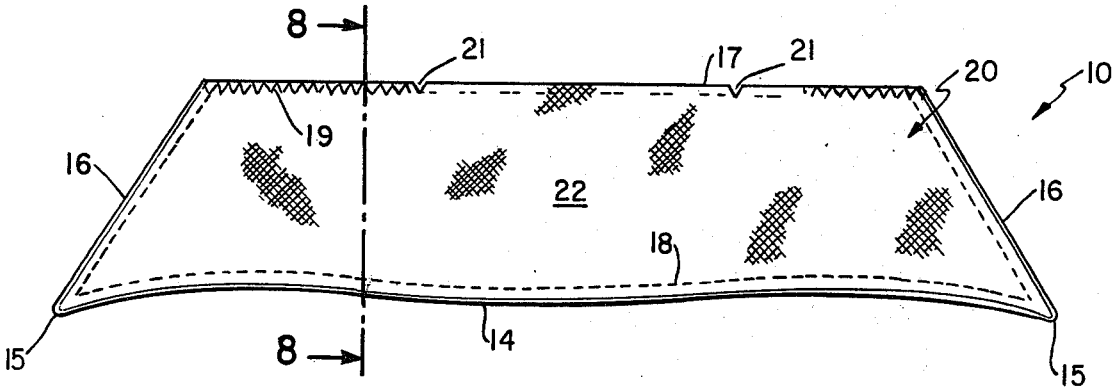
FIG. 7 is a top plan view of the completed collar after the pressing operation.
Figure 8:
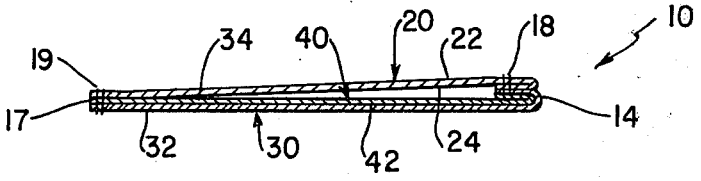
FIG. 8 is a sectional view taken along line 8—8 in FIG. 7.

Following the pressing operation, the collar is ready for attachment to the garment and has the form illustrated in FIGS. 7 and 8. As can be seen, the finished surfaces 22, 32 form the upper and lower surfaces, respectively, of the collar and the lining is fused to the unfinished surface 34 of lower facing strip 30. As a result of applying heat to both facing strips of the collar, backbleeding of the fusing material through the lining is achieved. This does not result in the unfinished surface 24 of upper facing strip 20 being bonded to the lining, but it does provide more stability and a better finished appearance for the collar.

Although a preferred embodiment of the invention has been disclosed for illustrative purposes, it will be appreciated by those skilled in the art that many additions, modifications, and substitutions are possible without departing from the scope and spirit of the invention as defined in the accompanying claims.

What is claimed is:

1. A method for making a garment collar from upper and lower facing strips of predetermined shape each having a finished and unfinished surface and a lining of said predetermined shape having one fusible surface, said method comprising the steps of:

stacking said facing strips in alignment with said lining so that said facing strips are on the same side of said lining, and so that the finished surface of said lower facing strip, the unfinished surface of said upper facing strip and the fusible surface of said lining all face in the same direction;

sewing a portion of the periphery of said stacked arrangement;

reversing the partially sewn arrangement so that said lining is disposed intermediate said facing strips;

sewing about the periphery of the reversed arrangement;

simultaneously applying pressure and heat so that the unfinished surface of said lower facing strip is fused to the fusible surface of said lining; and said collar including one edge adapted to be mounted to a garment, said method further including the step of providing a notch in said edge as a guide for aligning said collar with respect to said garment.

2. A method for making a garment collar from upper and lower facing strips of predetermined shape each having a finished and unfinished surface and a lining of said predetermined shape having one fusible surface, said method comprising the steps of:

stacking said facing strips in alignment with said lining so that said facing strips are on the same side of said lining, and so that the finished surface of said lower facing strip, the unfinished surface of said upper facing strip and the fusible surface of said lining all face in the same direction;

sewing a portion of the periphery of said stacked arrangement;

reversing the partially sewn arrangement so that said lining is disposed intermediate said facing strips;

sewing about the periphery of the reversed arrangement; and simultaneously applying pressure and heat so that the unfinished surface of said lower facing strip is fused to the fusible surface of said lining said applying step being performed by simultaneously applying pressure and heat to both of said facing strips so that a portion of said fusible surface is back-bled through said lining to said upper facing strip.

3. A collar formed by the method of either claim 1 or claim 2.

4. A method for making a collar substantially immune to surface imperfections resulting from washing and other normal treatment from a partially formed unit including upper and lower facing strips of predetermined shape aligned in opposed relationship and a lining secured in alignment between said facing strips, said lining being made of a fabric exhibiting substantially different shrinkage than the fabric of said facing strips and having one fusible surface directed toward said lower facing strip, said method comprising the step of compressing said unit between pressing surfaces, at least one of which is heated; said collar including one surface adapted to be mounted to a garment, said method further including the step of providing a notch in said edge as a guide for aligning said collar with respect to said garment.

5. A method for making a collar from a partially formed unit including upper and lower facing strips of predetermined shape aligned in opposed relationship and a lining secured in alignment between said facing strips, said lining having one fusible surface directed toward said lower facing strip, said method comprising the step of compressing said unit between pressing surfaces, wherein both of said pressing surfaces are heated so that a portion of said fusible surface is back-bled through said lining to said upper facing strip.

6. A collar formed by the method of either claim 4 or claim 5.

7. A collar for use in garments, which is substantially immune to surface imperfections resulting from washing and other normal treatment, said collar comprising upper and lower facing strips of predetermined shape aligned in opposed relationship and a lining of said predetermined shape made of a fabric exhibiting different shrinkage than the fabric of said facing strips and aligned between said facing strips, said lining having one surface thereof secured to said lower facing strip; said collar including one edge adapted to be mounted to the garment, said edge having at least one notch therein for use as an aid in aligning said collar with respect to said garment.

8. The collar of claim 7 wherein said lining includes a fusible coating which secures it to said lower facing strip.

9. A collar for use in garments comprising upper and lower facing strips of predetermined shape aligned in opposed relationship and a lining of said predetermined shape in alignment between said facing strips, said lining including a fusible coating which secures it to said lower facing strip, at least a portion of said fusible coating being back-bled through said lining to said upper facing strip.

10. The method in accordance with any one of the claims 2 or 5 wherein said collar includes one edge adapted to be mounted to a garment, at least one notch being provided in said edge as a guide for aligning said collar with respect to said garment.

11. A collar formed by the method of claim 10.

12. The collar in accordance with claim 9 wherein said collar includes one edge adapted to be mounted to a garment, said edge having at least one notch therein for use as an aid in aligning said collar with respect to said garment.

* * * * *